United States Patent [19]

Hannemann et al.

[11] Patent Number: 4,846,426

[45] Date of Patent: Jul. 11, 1989

[54] HANG-UP AND PROTECTIVE ARRANGEMENT FOR AN ELECTRICAL APPLIANCE

[75] Inventors: Peter Hannemann; Uwe Kemker; Hans-Joachim Birr, all of Wuppertal; Wieland Gühne, Remscheid, all of Fed. Rep. of Germany

[73] Assignee: Vorwerk & Co. Interholding GmbH, Wuppertal, Fed. Rep. of Germany

[21] Appl. No.: 205,951

[22] Filed: Jun. 13, 1988

[30] Foreign Application Priority Data

Jun. 12, 1987 [DE] Fed. Rep. of Germany ... 8708300[U]

[51] Int. Cl.[4] ..... A47G 29/00

[52] U.S. Cl. ..... 248/360; 248/51; 248/359 H

[58] Field of Search ..... 248/360, 339, 359 H, 248/359 G, 359 R, 51, 52, 362

[56] References Cited

U.S. PATENT DOCUMENTS

| | | | |
|---|---|---|---|
| 2,612,336 | 9/1952 | Tuttle | 248/359 H X |
| 3,341,047 | 9/1967 | Nauta | 248/359 H X |
| 4,060,215 | 11/1977 | Burns et al. | 248/359 G |
| 4,519,566 | 5/1985 | Manzi | 248/360 |

FOREIGN PATENT DOCUMENTS

| | | | |
|---|---|---|---|
| 0807524 | 4/1951 | Fed. Rep. of Germany | 248/359 H |

*Primary Examiner*—Ramon O. Ramirez

*Attorney, Agent, or Firm*—Walter Ottesen

[57] ABSTRACT

The invention relates to a hang-up and protective arrangement for an electrical appliance such as a vacuum cleaner or carpet cleaning apparatus having a guide wand. The guide wand is equipped with a handle having an end portion with an opening formed therein from which an electrical cable passes from the handle. A U-shaped bracket has respective legs which are pivotally connected to the end portion of the handle so as to straddle the cable. The bracket can pivot between a pivoted-out position whereat the bracket can be hanged on a wall-mounted hook and a pivoted-in position.

8 Claims, 3 Drawing Sheets

HANG-UP AND PROTECTIVE ARRANGEMENT FOR AN ELECTRICAL APPLIANCE

FIELD OF THE INVENTION

The invention relates to a hang-up and protective arrangement for electrical appliances having a guide wand such as handheld vacuum cleaners or carpet cleaning apparatus wherein a cable passes from the rearward end of the handle in a direction along the longitudinal axis thereof.

BACKGROUND OF THE INVENTION

The purpose of arrangements of this kind is to protect the electrical supply cable from severe bending. In such arrangements, it is a disadvantage that the cable casing is only adequate for normal use. However, this protective casing is inadequate to protect the electrical cable from excessive forces such as those which occur when the guide wand of a vacuum cleaner, for example, is dropped to the floor or when the appliance is hung up for storage. These excessive forces can lead to a breaking of the connecting cable.

Arrangements of this kind are known which include bending openings in the cable exit region which provide for a certain bending radius. For example, such an arrangement is known for handheld vacuum cleaners wherein a separate soft-elastic part is provided which takes up the increased bending of the cable.

With arrangements of this kind, it is a disadvantage that an additional part is needed which increases cost and only simplifies storing the appliance on a wall. The other possible excessive applications of stress on the cable are not protected. Arrangements are not provided which protect the cable of the unit when the latter is hung up and which also protect the cable in other situations such as when the guide wand is dropped.

SUMMARY OF THE INVENTION

It is an object of the invention to provide a hang-up and protective arrangement for the cable outlet which obviates the above-mentioned disadvantages and provides a maximum degree of free movement for normal use and nonetheless provides protection against excessive loading. It is a further object of the invention to provide such a protective arrangement which not only protects the cable but also facilitates hanging up the appliance when not in service.

The advantages of the arrangement according to the invention are seen especially in that the electrical cable exiting from the rearward region of the guide wand of the appliance is in no situation subjected to excessive loading which can sharply bend and break this cable thereby protecting the operator of the appliance as well as reducing the necessity of repairs.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
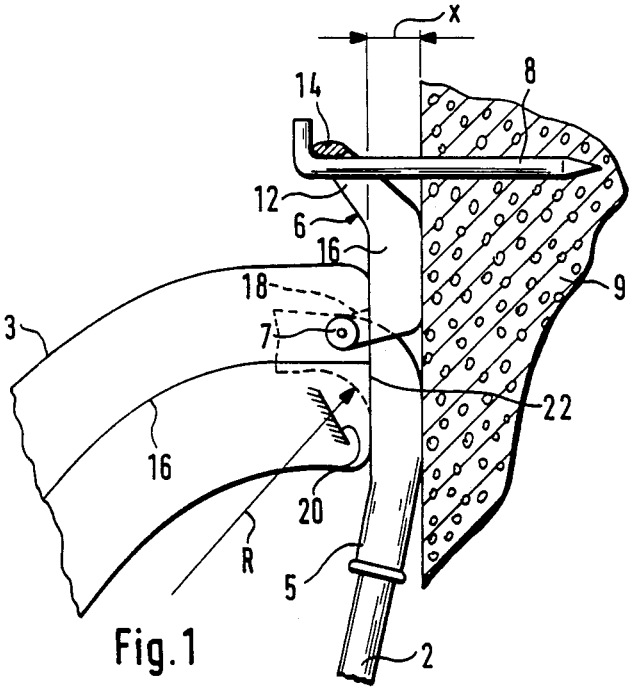
FIG. 1 is an enlarged side elevation view, partially in section, of an embodiment of the hang-up and protective arrangement according to the invention shown in the pivoted-out position.

FIG. 1 shows the end of a handle 3 of a floor vacuum cleaner 1 wherein the vacuum cleaner has been hung up on a hook 8 in a wall 9. The pivotally-movable hang-up and protective arrangement includes a U-shaped bracket 6 which is integrated into the handle 3 so as to pivotally rotate about pivot pins 7. The handle 3 has an end face 22 and comprises two half shells which are joined to each other at interface 16.

The U-shaped bracket 6 is shown in its pivoted-out position and includes two outer leg segments 12 connected together at the outer ends thereof by a bight segment 14 by means of which the U-shaped bracket 6 can engage the hook 8. The U-shaped bracket 6 includes respective intermediate leg segments 16 which come into contact engagement with the wall 9 when the appliance is hung up for storage as shown. Inner segments 18 of the U-shaped bracket 6 are shown in part with dashed lines and are pivotally connected at the inner wall of the hollow handle 3 with pivot pins 7.

When the appliance is removed from the hook 8, the U-shaped bracket 6 pivots downwardly in the clockwise direction through approximately 90° so that, in the pivoted-in position, the U-shaped bracket 6 lies with its inner segments 18 against respective abutment flats 20 disposed inside the annular hollow handle 3.

Figure 5:
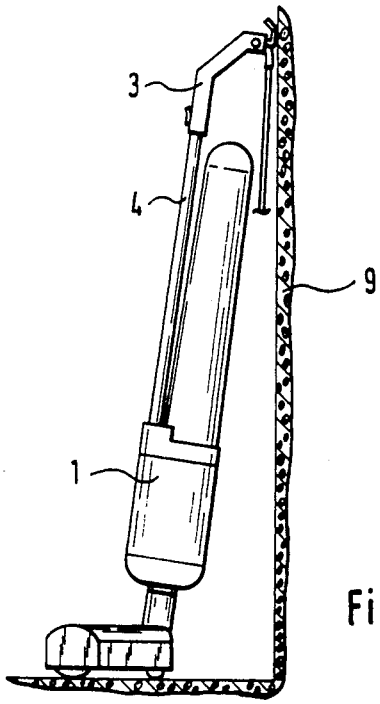
FIG. 5 is a side elevation view of a vacuum cleaner provided with the hang-up protective arrangement of the invention according to the embodiment of FIG. 1 with the handle thereof lying against a vertical wall; and, FIG. 6 shows a vacuum cleaner provided with the hang-up and protective arrangement of FIG. 1 which has been dropped and wherein the cable is protected against intense bending of the arrangement according to the invention.

The intermediate segments 16 of the legs of the U-shaped bracket keep the handle 3 away from the wall and provide space (x) for the cable 2 and its protective casing 5. In addition, space is provided within the end portion of the handle 3 to allow the cable 2 and its casing 5 to bend within this end portion as shown and to allow the radius of curvature R to decrease to correspond to the curvature shown in FIG. 1. Accordingly, when the appliance is hung up as shown in FIG. 1 or simply placed next to a wall 9 as shown in FIG. 5, the cable 2 and its casing 5 are not caused to bend sharply. Instead, the radius of curvature R simply decreases to provide the curvature for the cable 2 shown in FIG. 1.

Figure 2:
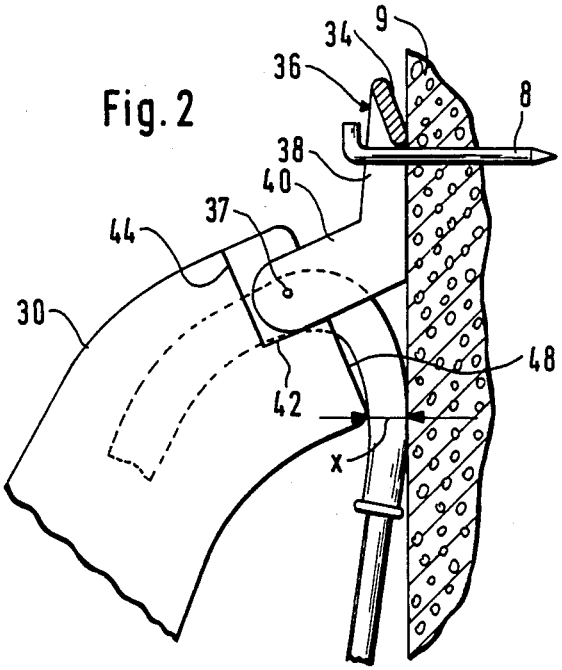
FIG. 2 is a side elevation view, partially in section, of an alternate embodiment of the hang-up and protective arrangement according to the invention shown in the pivoted-out position.

FIG. 2 is an alternate embodiment of the hang-up and protective arrangement according to the invention wherein the U-shaped bracket 36 is pivotally connected by pivot pins 37 at the outer wall surface of the end portion of the handle 30 of the electrical appliance. The bracket 36 is shown placed upon a hook 8 in wall 9 and is in the pivoted-out position. The U-shaped bracket 36 includes two mutually parallel outer segments 38 interconnected by a bight portion 34. Two lower segments 40 integral with corresponding ones of the outer segments 38 are pivotally connected at the outer wall surface of the handle 30 as described above.

The U-shaped bracket 36 is pivotally mounted in two recesses on respective sides of the end portion of the handle 30 as shown in FIG. 2. Each of the recesses are conjointly defined by two abutment flats 42 and 44 of which the first abutment flat 42 defines the pivoted-out position of the U-shaped bracket 36 and the second abutment flat 44 defines the pivoted-in position thereof.

In FIG. 2, the U-shaped bracket is shown placed upon a hook 8 in wall 9. Here, the first abutment flat 42 extends the rearward end face 48 of the handle 30 and braces the handle 30 so that it does not rotate about pivot pin 37 against the wall 9. In addition, space (x) is provided for the cable 2 as shown. This enables the cable 2 to bend as shown and yet be protected against severe loading which would cause it to wear or break prematurely.

Figure 3:
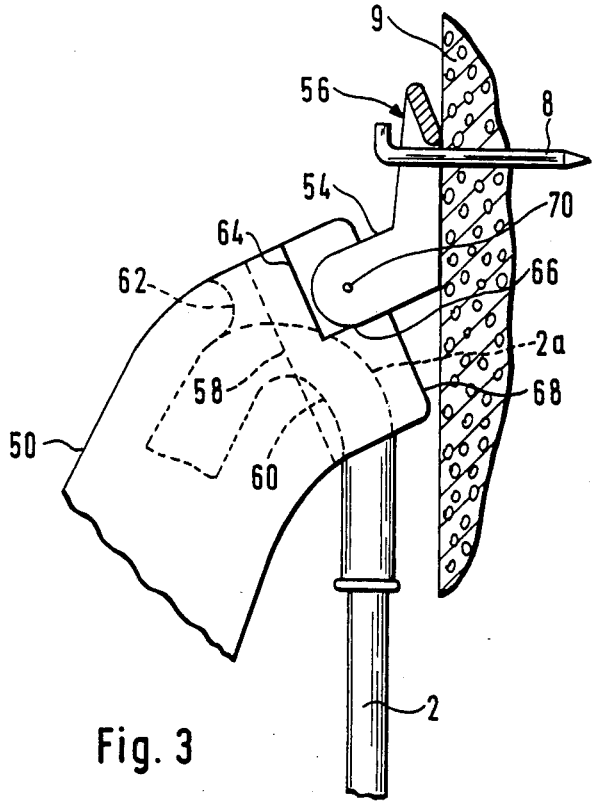
FIG. 3 is a side elevation view of still another embodiment of the invention similar to that shown in FIG. 2 wherein a vertical slot is provided in the end face of the handle of the appliance.
Figure 4:
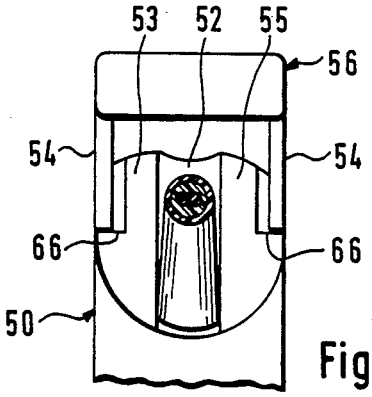
FIG. 4 is an elevation view of the end of the handle of the embodiment shown in FIG. 3.

According to a further feature of the invention and referring to FIGS. 3 and 4, a vertical notch 52 is provided in the end face of the handle 50 between the two legs 54 of the U-shaped bracket 56 so that the curved portion 2a of the cable can be accommodated entirely within the handle and exit at the lower portion thereof as shown in FIG. 3. The rearward wall surface of the notch 52 is shown in FIG. 3 by the dashed line 58. The notch 52 is disposed between two end surfaces 53 and 55 shown in FIG. 4.

The abutment surfaces 64 and 66 formed on the outer wall define the pivoted-in and pivoted-out positions in the same manner as described for the abutment surfaces in connection with the embodiment of FIG. 2.

In the embodiment of FIGS. 3 and 4, the cable 2 can lie against a curved surface 60 formed in the handle 50 and shown in dotted outline in FIG. 3. The curved surface 60 prevents the cable from bending too sharply thereby preventing a premature breaking thereof.

During use of the vacuum cleaner, it can occur that the operator steps on the cable 2 and applies a downward pulling force thereto. For this condition too, the cable 2 is accommodated in the notch and allowed to bend according to the radius of curvature defined by the curved surface 60. An additional curved surface 62 is provided above the cable 2 to receive the cable 2 thereagainst in the event that it is pushed upwardly, for example, when the handle is allowed to drop to the floor.

FIG. 5 shows a vacuum cleaner having a guide wand equipped with the U-shaped bracket of FIG. 1 with the intermediate leg segments 16 being provided with contact engaging surfaces having an inclination selected so as to permit the latter to lie flat against the wall 9 when the vacuum cleaning apparatus is positioned up against the wall when not in use.

Figure 6:
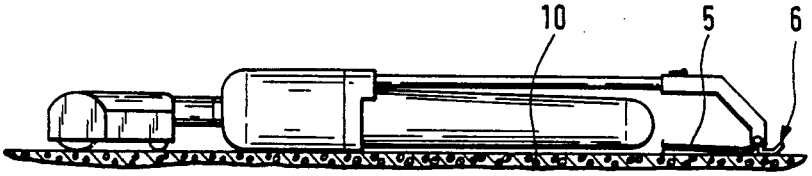

FIG. 6 shows the guide wand when the handle has been dropped to the floor and how the U-shaped bracket 6 of FIG. 1 functions to protect the cable 2 against intense bending by providing a safety space for the cable 2 defined by the thickness of the intermediate segment 16.

It is understood that the foregoing description is that of the preferred embodiments of the invention and that various changes and modifications may be made thereto without departing from the spirit and scope of the invention as defined in the appended claims.

What is claimed is:

1. An electrical appliance such as a vacuum cleaner or carpet cleaning apparatus, the electrical appliance comprising:

a guide wand;

a handle extending outwardly from said guide wand;

an electrical cable mounted in said guide wand and said handle so as to be substantially concentric therewith;

said handle having an upper outermost end portion with an opening formed therein from which said cable passes from the handle;

a U-shaped bracket having respective legs pivotally connected to said end portion so as to straddle said cable for pivoting between a pivoted-out position whereat said bracket can be hung on a wall-mounted hook and a pivoted-in position;

said end portion of said handle having an end face; each of said legs of said bracket having a lower segment pivotally connected to said end portion and an intermediate segment integral with said lower segment so as to conjointly define an angle therewith;

abutment means formed in said end portion for defining said pivoted-in position;

said angle being selected so as to cause said intermediate segment to be in contact engagement with said end face to define said pivoted-out positions; and, said intermediate segment having a thickness (x) selected so as to permit said cable to pass from said end face and between the latter and a wall surface when said bracket is hung on a hook.

2. The arrangement of claim 1, said handle having an annular wall defining an inner wall surface; and, said legs being pivotally connected to said end portion on diametrically opposite sides of said inner wall surface.

3. An electrical appliance such as a vacuum cleaner or carpet cleaning apparatus, the electrical appliance comprising:

a guide wand;

a handle extending outwardly from said guide wand and having an upper outermost end portion terminating in an end face;

an electrical cable mounted in said guide wand and said handle so as to be substantially concentric therewith;

said legs being pivotally connected to said end portion on diametrically opposite sides thereof;

first and second abutment means formed on each one of said sides of said end portion to define said pivoted-in and pivoted-out positions, respectively; each of said legs of said bracket including a lower segment pivotally connected to said end portion and having respective edges for coacting with corresponding ones of said first and second abutment means, and an upper segment conjointly defining an angle with said lower segment selected so as to define a spacing (x) between said end portion and a wall on which said bracket is hung when in said pivoted-out position which is sufficient to permit the cable to pass from said end face and between said end portion of the handle and the surface of the wall.

4. The arrangement of claim 3, said end portion having an outer wall surface and said legs being pivotally connected so said outer wall surface on diametrically opposite sides of said end portion.

5. The arrangement of claim 3, said end portion having an end face; and, said second abutment means extending outwardly toward said end face so as to brace said handle against said lower segment to prevent said handle from rotating toward the wall when said bracket is placed on the wall-mounted hook.

6. An electrical appliance such as a vacuum cleaner or carpet cleaning apparatus, the electrical appliance comprising:

a guide wand;

a handle extending outwardly from said guide wand and having an upper outermost end portion;

an electrical cable mounted in said guide wand and said handle so as to be substantially concentric therewith;

said legs being pivotally connected to said end portion on diametrically opposite sides thereof;

first and second abutment means formed on each one of said sides of said end portion to define said pivoted-in and pivoted-out positions, respectively; each of said legs of said bracket including a lower segment pivotally connected to said end portion and having respective edges for coacting with corresponding ones of said first and second abutment means, and an upper segment conjointly defining an obtuse angle with said lower segment; said second abutment means extending outwardly so as to brace said handle against said lower segment to prevent said handle from rotating downwardly toward the wall when said bracket is placed on the wall-mounted hook.

7. The arrangement of claim 6, said end portion defining a longitudinal axis; and, slot means formed in said end portion so as to extend in a direction substantially perpendicular to said axis to define an opening at least in the bottom of said end portion through which said cable can pass out downwardly from said handle.

8. The arrangement of claim 7, comprising curved surface means formed in said end portion adjacent said slot means for receiving the cable thereagainst to protect the same against breakage when a stress load is applied thereto.

* * * * *

UNITED STATES PATENT AND TRADEMARK OFFICE

CERTIFICATE OF CORRECTION

PATENT NO. : 4,846,426

DATED : July 11, 1989

INVENTOR(S) : Peter Hannemann, Uwe Kemker, Hans-Joachim Birr and Wieland Gühne

It is certified that error appears in the above-identified patent and that said Letters Patent is hereby corrected as shown below:

On the title page, under "ABSTRACT", line 10: delete "hanged" and substitute -- hung -- therefor.

In column 2, line 8: insert -- and -- between "hang-up" and "protective".

In column 2, line 15: delete "of" and substitute -- by -- therefor.

In column 4, line 27: delete "positions;" and substitute -- position; -- therefor.

Signed and Sealed this

Tenth Day of April, 1990

*Attest:*

HARRY F. MANBECK, JR.

*Attesting Officer*

*Commissioner of Patents and Trademarks*